United States Patent [19]

Weiner

[11] Patent Number: 4,511,397

[45] Date of Patent: Apr. 16, 1985

[54] PROCESS FOR INCREASING THE DEGREE OF AFTERBURNING OF CARBON MONOXIDE IN THE REFINING OF IRON MELTS

[75] Inventor: Antoine Weiner, Luxembourg, Luxembourg

[73] Assignee: Arbed S.A., Luxembourg, Luxembourg

[21] Appl. No.: 539,260

[22] Filed: Oct. 5, 1983

[30] Foreign Application Priority Data

Oct. 6, 1982 [LU] Luxembourg ..... 84409

[51] Int. Cl.[3] ..... C21C 7/00

[52] U.S. Cl. ..... 75/59.17; 75/52; 75/53

[58] Field of Search ..... 75/52, 60, 53

[56] References Cited

U.S. PATENT DOCUMENTS

| | | | |
|---|---|---|---|
| 2,991,173 | 7/1961 | Trentini | 75/60 |
| 3,820,768 | 6/1974 | Sieckman | 75/52 |
| 3,839,017 | 10/1974 | Schempp | 75/52 |

*Primary Examiner*—Peter D. Rosenberg
*Attorney, Agent, or Firm*—Fishman & Dionne

[57] ABSTRACT

A process for increasing the extent of afterburning of carbon monoxide formed during the decarburization of iron melts by the action of oxygen is presented. This process is accomplished by delivering a finely divided catalyst to the space above the iron bath. The catalyst may be comprised of any number of catalysts which promote carbon monoxide afterburning, and is preferably a metal oxide compound. The catalyst is preferably delivered via an oxygen blowing lance and effectively increases carbon monoxide afterburning even at very high temperatures.

7 Claims, No Drawings

PROCESS FOR INCREASING THE DEGREE OF AFTERBURNING OF CARBON MONOXIDE IN THE REFINING OF IRON MELTS

BACKGROUND OF THE INVENTION

The present invention relates to a new and improved process for increasing the extent of afterburning of carbon monoxide (CO) formed during the decarburization of iron melts by the action of oxygen.

Carbon monoxide afterburning over a steel bath surface is well known to those skilled in the art of steel production. This CO afterburning has been necessitated in order to introduce larger charges of cooling materials such as scrap, spongy iron, etc. into the iron bath. In actual practice, additional oxygen made available over the bath by means of special blowing lances and the like. This additional oxygen acts in concert with the CO afterburning to substantially increase the amount of energy which is supplied or available to the bath.

In Luxembourg Pat. Nos. LU81,207, LU 81,853 and LU 83,354, which are assigned to the assignee hereof and are incorporated herein by reference, Applicant describes several processes wherein the amount of energy supplied or available from CO afterburning is increased. During the refining process, the liquidous slag layer floating on the bath takes on a foamy consistency. It has been shown that this foamy slag layer acts as in insulator whereby heat produced by the CO afterburning is undesirably shielded from the bath. Obviously, by preventing formation of slag foaming, an increase in heat transfer between the CO combustion and bath may be accomplished. The methods of the above referenced patents are directed at this particular problem by providing processes which inhibit the foaming of slag.

Carbon Monoxide undergoes combustion according to the formula:

$$2CO + O_2 \rightleftharpoons 2CO_2 + X \text{ Joules}$$

Unfortunately, the above chemical reaction has an equilibrium point which is significantly displaced to the left at high reaction temperatures. Since the temperatures of the iron bath are extremely high, a great deal of the CO remains unreacted (noncombusted) despite the use of a great excess of oxygen. As a consequence of this undesirable equilibrium, the CO afterburning is incomplete resulting in the CO escaping through the melting shop fireplace or smokestack. As the bath cools to lower temperatures, the equilibrium shifts and the CO easily combusts, only by this point in the refining process, the energy released by combustion is no longer helpful or necessary.

SUMMARY OF THE INVENTION

The above discussed and other problems of the prior art are overcome or alleviated by the process of the present invention. In accordance with the present invention, a novel process permits in carbon monoxide afterburning to proceed more fully (i.e., further to the right of the equilibrium formula) even at the high temperatures existing above the bath surface, thereby providing greater economy and efficient use of available energy sources.

The method of the present invention is preferably accomplished by supplying a finely divided catalyst to the space above the bath surface. The catalyst should consist of any of a number of catalysts which promote carbon monoxide afterburning, preferably metal oxide catalysts.

DESCRIPTION OF THE PREFERRED EMBODIMENT

The novel process of the present invention vastly increases the degree of afterburning of carbon monoxide formed during decarburization of iron smelts in the presence of oxygen by utilization of a combustion catalyst introduced into the space immediately above the bath surface.

In a preferred embodiment, the combustion catalyst is delivered in particulate form to the bath by an oxygen blowing lance. Modern, conventional oxygen blowing lances are equipped with a plurality of feed circuits, usually a primary and one or more secondary circuits. The primary feed circuit delivers an essentially vertical gas jet whose function is to decarburize the charge. Additionally, at least one secondary circuit on the lance provides oxygen for the afterburning of carbon monoxide.

These lances are not only capable of delivering a gas flow, but can also deliver particulate matter as well. In a preferred embodiment of the present invention, the combustion catalyst is delivered to the area above the bath by use of a secondary feed circuit in the lance. The secondary feed circuit for delivery of the catalyst may be the secondary circuit used to supply oxygen for afterburning; or it may be a separate secondary circuit. The catalyst is blown into the appropriate space above the bath by entraining or suspending the catalyst in any suitable gas medium (perferably oxygen which, of course it will be, if the catalyst is entrained in the oxygen supply for afterburning). A secondary feed circuit in the lance is especially suited for this application as it is both inclined in direction and attenuated in flow in relation to the primary jet and does not penetrate into the melt (i.e., it is delivered somewhat diagonally or across the surface of the bath). In particular, an oxygen blowing lance with secondary feed circuits which is easily used in the process of the present invention is described in Luxembourg Pat. No. LU 82,846, which is assigned to the assignee hereof and is incorporated herein by reference. As a result of effectively combining the process of the present invention with the lance described in LU 82,846, one of the secondary circuits of the lance is equipped with a conventional metering device for solids. It has also been found that an additional circuit providing a gentle oxygen stream will facilitate CO afterburning if the oxygen is blown diagonally in the direction of the bath surface.

Preferably, the suitable catalyst is in a particulate form which has been finely divided and is capable of undergoing spraying or entrainment with a delivery gas. While any catalyst which is generally suitable for promoting carbon monoxide afterburning will suffice in accomplishing the objects of the present invention, it has been found that metal oxides, especially finely divided manganese dioxide are preferable.

The novel process of the present invention as heretofore described provides increased efficiency and economy in carbon monoxide afterburning even at the commonly high temperature encountered at the steel bath surface by substantially increasing the extent of CO combustion in opposition to the usual reaction equilibrium.

While preferred embodiments have been described, various modifications and substitutions may be made thereto without departing from the spirit and scope of the invention. Accordingly, it is to be understood that the present invention has been described by way of illustrations and not limitation.

What is claimed is:

1. A process for increasing the extent of afterburning of carbon monoxide formed during decarburization of iron by the action of oxygen including the steps of:

providing a catalyst which promotes the afterburning of carbon monoxide; and delivering said catalyst to the space above the surface of an iron bath.

2. The process according to claim 1 wherein said catalyst is finely divided.

3. The process according to claim 1 wherein said catalyst is a metal oxide.

4. The process according to claim 3 wherein said metal oxide catalyst is manganese dioxide.

5. The process according to claim 1 wherein said catalyst is suspended in a gas.

6. The process according to claim 5 wherein said suspended catalyst is delivered by an oxygen blowing lance.

7. The process according to claim 6 wherein oxygen is blown diagonally in the direction of the bath surface.

* * * * *